US006480684B2

(12) United States Patent
Shindo

(10) Patent No.: US 6,480,684 B2
(45) Date of Patent: Nov. 12, 2002

(54) CIRCULATION SYSTEM FOR AN IMAGE DEVELOPER WITH AN AGITATOR MOTOR RESPONSIVE TO AN AMOUNT OF DEVELOPER IN A STORAGE TANK

(75) Inventor: Kazunori Shindo, Kashiwazaki (JP)

(73) Assignee: Fuji Xerox Co., Ltd. (JP)

( * ) Notice: Subject to any disclaimer, the term of this patent is extended or adjusted under 35 U.S.C. 154(b) by 0 days.

(21) Appl. No.: 09/859,996

(22) Filed: May 17, 2001

(65) Prior Publication Data

US 2001/0046392 A1 Nov. 29, 2001

(30) Foreign Application Priority Data

May 24, 2000 (JP) ..... 2000-153673

(51) Int. Cl.[7] ..... G03G 15/10
(52) U.S. Cl. ..... 399/57; 399/238
(58) Field of Search ..... 399/57, 58, 237, 399/238

(56) References Cited

U.S. PATENT DOCUMENTS 3,957,368 A * 5/1976 Goshima et al. ..... 399/203
3,994,257 A * 11/1976 Komori et al. ..... 399/57

FOREIGN PATENT DOCUMENTS

| | | |
|---|---|---|
| JP | 56-7959 | 1/1981 |
| JP | 56-81869 | 7/1981 |
| JP | 56-83755 | 7/1981 |
| JP | 60-98853 | 7/1985 |
| JP | 11-249444 | 9/1999 |
| JP | 2000-19851 | 1/2000 |

* cited by examiner

*Primary Examiner*—Fred L Braun
(74) *Attorney, Agent, or Firm*—Ostrolenk, Faber, Gerb & Soffen, LLP

(57) ABSTRACT

A developer circulation system includes a storage tank which stores a developer, a development device, a developer supply passage through which the developer is supplied to the development device from the storage tank, a developer return passage through which the developer is returned to the storage tank from the development device, a circulation pump, and an agitation member which agitates the developer in the storage tank. An outlet of the developer return passage and an opening of the developer supply passage are located in the storage tank, so as to promote a flow of the developer generated by the rotation of the agitation member, at positions furthest from each other along a flow of the developer from the outlet of the developer return passage and the opening of the developer supply passage.

1 Claim, 2 Drawing Sheets

CIRCULATION SYSTEM FOR AN IMAGE DEVELOPER WITH AN AGITATOR MOTOR RESPONSIVE TO AN AMOUNT OF DEVELOPER IN A STORAGE TANK

BACKGROUND OF THE INVENTION

1. Field of the Invention

The present invention relates to a development system used for an image formation device, such as a printer, a facsimile, or a copier. More specifically, the present invention relates to a developer circulation system which may be used for circulating a developer to be used in a development system. Especially, the present invention relates to an agitation device which agitates a developer contained in a storage tank of a developer circulation system.

2. Description of Related Art

In general, a developer used in a development system contains a toner which is dispersed in a carrier liquid. Also, a development system includes a development device for carrying out a development process, and a storage tank for storing a developer. In the development system, the developer is transferred to the development device from the storage tank, and the developer which was transferred to the development device is returned to the storage tank so that the developer may be circulated between the two.

However, the concentration of toner in the developer, which is returned to the storage tank from the development device, is not only lowered, but also the size of the toner particles and the dispersibility thereof in the carrier liquid are changed because of the high electric field applied to the developer in the development device. Since a constant image concentration cannot be obtained if the state of the developer is varied, the concentration of the developer is generally controlled to be within a predetermined range during a printing process by using a device which adjusts the state of the developer. In general, the device is placed within the storage tank, and has a rotating agitation member of a propeller shape to agitate a developer by using the agitation member.

However, in the above-mentioned conventional device or technique, since a certain amount of the developer remains in the development device when the developer is circulated during a development process, the amount of the developer in the storage tank is decreased and a sufficient agitation thereof cannot be achieved.

Also, if the agitation process is carried out for a small amount of the developer by using the same conditions for a large amount of the developer, the liquid surface of the developer may be disturbed and air bubbles may be induced in the developer. Moreover, if the surface of the developer is disturbed, the amount of the developer may not be detected in a stable manner. On the other hand, if the agitation condition is changed to be appropriate for a case where the amount of the developer in the storage tank is small, a sufficient agitation process cannot be achieved for the large amount of the developer.

The present invention takes into consideration the above-mentioned circumstances, with an object of providing a developer circulation system having an agitation device which is capable of carrying out an appropriate agitation process regardless of whether it is performed during a development process, i.e., regardless of the amount of the developer in the storage tank.

SUMMARY OF THE INVENTION

The present invention provides a developer circulation system including: a storage tank which stores a developer including a carrier liquid and a toner; a development device which carries out a development process using the developer supplied from the storage tank; a developer supply passage through which the developer is supplied to the development device from the storage tank; a developer return passage through which the developer is returned to the storage tank from the development device; a circulation pump which supplies the developer in the storage tank to the development device via the developer supply passage, the circulation pump also returns the developer in the development device to the storage tank via the developer return passage; and an agitation member which agitates the developer in the storage tank, wherein an outlet of the developer return passage and an opening of the developer supply passage are located in the storage tank, so as to promote a flow of the developer generated by the rotation of the agitation member, at positions furthest from each other along a flow of the developer from the outlet of the developer return passage and the opening of the developer supply passage.

In accordance with another aspect of the invention, the above developer circulation system further includes: a level sensor which measures the amount of the developer in the storage tank; an agitation motor which rotates the agitation member; and a control unit which adjusts the rotation speed of the agitation motor to one of the different levels of the rotation speed in accordance with the amount of the developer in the storage tank which is measured by the level sensor.

BRIEF DESCRIPTION OF THE DRAWINGS

Some of the features and advantages of the invention have been described, and others will become apparent from the detailed description which follows and from the accompanying drawings, in which:

FIG. 1(*b*) is a diagram showing a side view of the developer circulation system according to the embodiment of the present invention;

FIG. 2(*b*) is a diagram showing the positional relationship between the surface of the developer and the agitation member in the storage tank.

DETAILED DESCRIPTION OF THE INVENTION

The invention summarized above and defined by the enumerated claims may be better understood by referring to the following detailed description, which should be read with reference to the accompanying diagrams. This detailed description of a particular preferred embodiment, set out below to enable one to build and use one particular implementation of the invention, is not intended to limit the enumerated claims, but to serve as a particular example thereof.

Figure 1A:
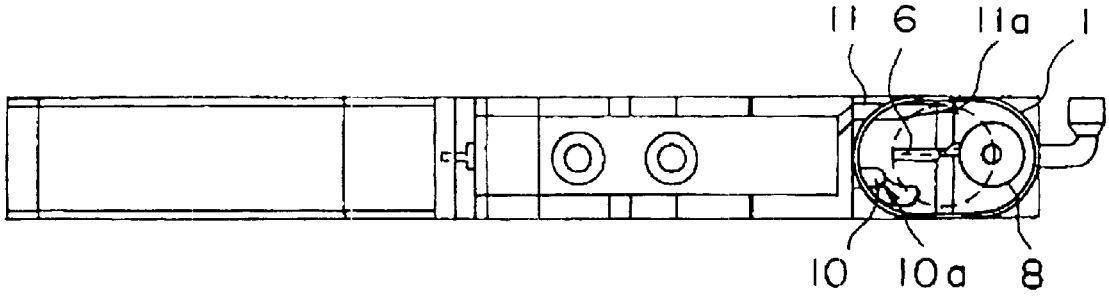
FIG. 1(*a*) is a diagram showing a top view of a developer circulation system according to an embodiment of the present invention.
Figure 1B:
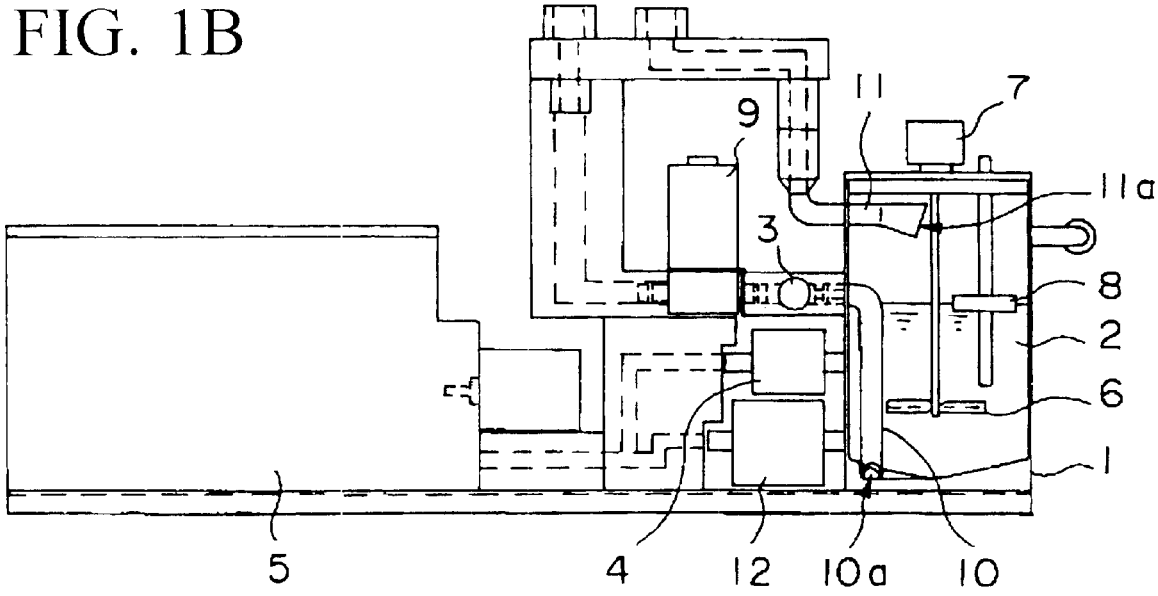

FIG. 1(*a*) is a diagram showing a top view of a developer circulation system according to an embodiment of the present invention. FIG. 1(*b*) is a diagram showing a side view of the developer circulation system according to the embodiment of the present invention. Note that a part of the wall of a storage tank 1 shown in FIG. 1(*b*) is omitted to show the internal structure of the storage tank 1.

The storage tank 1 stores a developer 2 containing a toner which is mixed with a carrier liquid. The storage tank 1 used in this embodiment has a smoothly curved internal side surface and a flat inner bottom surface. The cross-section of the side surface may have a flat oval shape as shown in FIG. 1(*a*). The developer 2 may be prepared by mixing the toner and the carrier liquid so that its concentration falls within a suitable range for image formation. The concentration of toner which is suitable for image formation may be within the range of about 2%–3% by weight solid content ratio. The toner concentration may be adjusted by a process carried out by a control circuit (not shown in the figures) in which a toner is supplied to the storage tank 1 from a toner cartridge 5 by using a toner supply pump 4, based on the concentration information detected by a concentration censor 3.

An agitation member 6 of propeller shape is disposed within the storage tank 1. The shaft of the agitation member 6 is connected to an agitation motor 7 so that the developer in the storage tank 1 is agitated when the agitation motor 7 rotates the agitation member 6 of propeller shape. The rotation speed of the agitation motor 7 may be controlled by a control circuit which is not shown in the figures. If a stepping motor is used as the agitation motor 7, the rotation speed thereof may be arbitrary adjusted in accordance with its needs.

A level sensor 8 is also disposed within the storage tank 1. The level sensor 8 includes a shaft provided with an internal magnetic position sensor, and a float which floats on the surface of the developer 2 in the storage tank 1. The amount of the developer in the storage tank 1 is determined based on the position of the float, which is detected by the internal magnetic position sensor, and the result of detection is transmitted to the control circuit.

The developer 2 in the storage tank 1 is drawn into an end portion of a developer supply passage, i.e., a suction opening 10*a* positioned at the inside of the storage tank 1, and is supplied to a development device (not shown in the figures), which is connected to the other end of the developer supply passage, via the concentration sensor 3. The developer 2, after being used for a development process in the development device, passes through a developer return passage 11 and is returned to the storage tank 1 from an outlet 11*a*.

As shown in FIG. 1(*a*), the outlet 11*a* and the suction opening 10*a* are located at positions along the inner side surface of the storage tank 1. Also, the direction of the flow of the developer 2 discharged from the outlet 11*a* is the direction along the inner side surface of the storage tank 1. That is, the direction of the developer 2 discharged from the outlet 11*a* is substantially parallel to the inner side surface of the storage tank 1. Moreover, the direction of the flow of the developer 2 drawn into the suction opening 10*a* is also along the inner side surface of the storage tank 1.

Note that a developer discharge pump 12 is used when the developer 2 is discharged from the storage tank 1.

Next, the operation of the developer circulation system according to an embodiment of the present invention will be described. Prior to starting a printing process, the agitation member 6 is rotated at about 800 rpm by the agitation motor 7 to agitate the developer 2 in the storage tank 1 so that the toner precipitated on the bottom of the storage tank 1 may be re-dispersed in the liquid carrier. If a printing process has not been carried out for a long time, it may be necessary to re-disperse the toner for about 30 seconds to two minutes. This re-dispersion process is necessary because if the toner contained in the developer 2 is highly concentrated on the bottom surface of the storage tank 1, there is a possibility that the control of toner concentration thereafter cannot be carried out properly. Also, although the appropriate particle size of toner is about 0.5 to 2 μm, toner particles having a particle size of 10 μm or larger may be present in the developer 2 if the re-dispersion thereof is not sufficiently carried out, and this may become a cause of a defect in printing images.

Figure 2A:
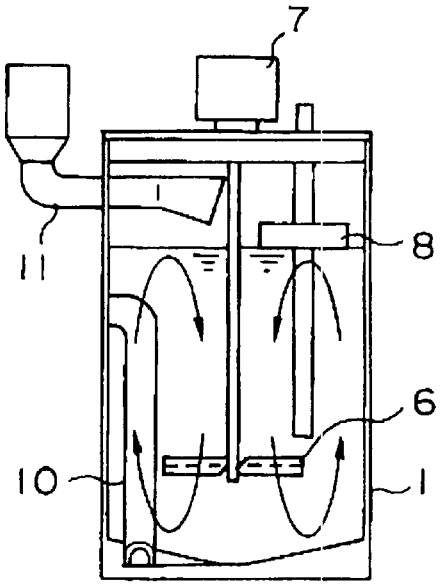
FIG. 2(*a*) is a diagram showing the positional relationship between the surface of a developer and an agitation member in a storage tank.
Figure 2B:
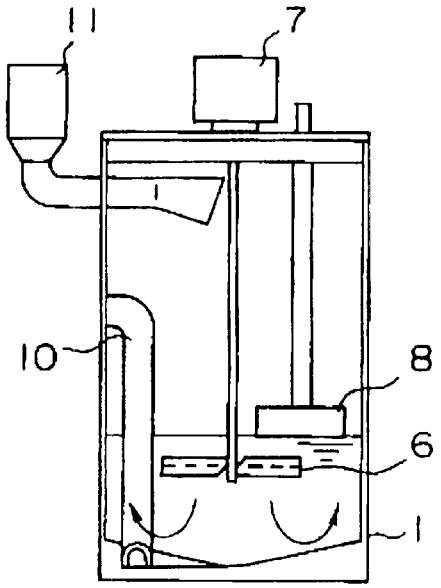

The volume of the storage tank 1 according to the embodiment of the present invention is about 400 ml, and the amount of the developer 2 contained in the storage tank 1 prior to starting a printing process is about 350 ml±50 ml. That is, as shown in FIG. 2(*a*), the developer 2 is filled in the storage tank 1 to nearly a full level and the agitation member 6 is sufficiently immersed in the developer 2. In that state, the agitation member 6 is designed to generate convection, by its rotation, together with a flow rotating around a horizontal plane, in an up and down direction as indicated by arrows shown in FIG. 2(*a*). The agitation member 6 makes the developer 2 homogeneous by creating the convection which re-disperses the toner deposited on or in the vicinity of the bottom surface of the storage tank 1.

When the printing process is started, the circulation pump 9 is actuated and about 150 to 200 ml of the developer 2 initially contained in the storage tank 1 is supplied to the development device, and the developer supply passage 10 and the developer return passage 11, each of which connects the development device and the storage tank 1. For this reason, about 100 to 150 ml of the developer 2 remains in the storage tank 1. At that time, the level of the developer 2 in the storage tank 1 is lowered to a position shown in FIG. 2(*b*) and if the agitation member 6 is rotated at 800 rpm, as in prior to the start of the printing process, air bubbles are produced in the developer 2 by the rotation of the agitating member 6. Also, since the surface of the developer 2 is vigorously vibrated, the position of the float of the level sensor 8 becomes unstable and the level of the developer surface cannot be accurately detected by the level sensor 8.

Figure 3:
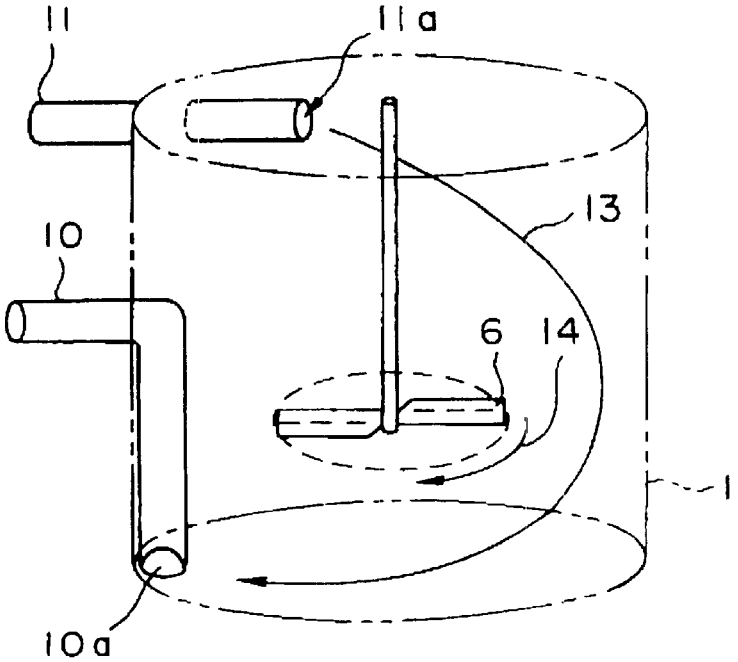
FIG. 3 is a diagram showing the concept of an operation in the storage tank during a printing process according to the embodiment of the present invention

FIG. 3 is a diagram showing the concept of an operation in the storage tank 1 during the printing process according to an embodiment of the present invention. The developer 2, which is returned to the storage tank 1 from the development device via the developer return passage 11, flows along the inner side surface (i.e., a smoothly curved surface) of the storage tank 1. That is, the developer 2 flows inside the storage tank 1 along the direction indicated by an arrow 13 shown in FIG. 3. At that time, the agitation member 6 is rotated at a low speed of 400 rpm or less so that the liquid surface of the developer 2, the level of which has been lowered as compared with prior to the start of the printing process, is not disturbed. The control of the rotation speed of the agitation member 6 is carried out by a control circuit (not shown in the figures) which controls the agitation motor 7.

The one end of the developer supply passage 10, i.e., the suction opening 10*a*, is located above the bottom surface of the storage tank 1 and at a position furthest from the one end of the developer return passage 11, i.e., the outlet 11*a*, along the flow of the developer 2. That is, the suction opening 10*a* is located at nearly the end of an arrow 13, shown in FIG. 3, which indicates the flow of the developer 2. The flow of the developer 2 in the direction indicated by the arrow 13 may be created in the storage tank 1 if the outlet 11*a* of the developer return passage 11 and the suction opening 10*a* of the developer supply passage 10 are located at positions mentioned above and the developer 2 is circulated at a rate of 600 to 1,000 ml per minute by using the circulation pump 9.

The flow of the developer 2 which proceeds in the above-mentioned direction promotes the flow of developer 2, generated by the rotation of the agitation member 6, which is indicated by an arrow 14 shown in FIG. 3. Accordingly, in that situation, the developer 2 may be sufficiently agitated and the toner re-dispersed without rotating the agitation member 6 at all, or rotating the agitation member 6 at a low speed of 400 rpm or less. The control of the rotation speed or switch-on/off of the agitation motor 7, which rotates the agitation member 6, is performed by a control circuit which is not shown in the figures. An example of such a control circuit includes a microprocessor.

Note that it is possible to vary the rotation speed of the agitation motor 7 in accordance with the amount of the developer 2 in the storage tank 1, which is detected by the level sensor 8, to realize an optimum dispersion state of the toner regardless of the amount of the developer 2 in the storage tank 1.

According to the present invention, even if the position of the surface of the developer in the storage tank is changed between prior and during/after a printing process, in which the circulation pump is not actuated in the former and is actuated in the latter, a sufficient agitation of the developer may be carried out without producing air bubbles in the developer.

Also, according to the present invention, since it is not necessary to keep the agitation motor in its high rotational state all the time, the power consumed by the agitation motor may be decreased, and the increase in the ambient temperature due to heat generated by the agitation motor may be reduced.

Having thus described exemplary embodiments of the invention, it will be apparent that various alterations, modifications, and improvements will readily occur to those skilled in the art. Such alterations, modifications, and improvements, though not expressly described above, are nonetheless intended and implied to be within the spirit and scope of the invention. The foregoing discussion is intended to be illustrative only; the invention is limited and defined only by the following claims and equivalents thereto.

What is claimed is:

1. A developer circulation system, comprising:

a storage tank which stores a developer including a carrier liquid and a toner;

a development device which carries out a development process using the developer supplied from the storage tank;

a developer supply passage through which the developer is supplied to the development device from the storage tank;

a developer return passage through which the developer is returned to the storage tank from the development device;

a circulation pump which supplies the developer in the storage tank to the development device via the developer supply passage, the circulation pump also returns the developer in the development device to the storage tank via the developer return passage; and an agitation member which agitates the developer in the storage tank, wherein an outlet of the developer return passage and an opening of the developer supply passage are located in the storage tank, so as to promote a flow of the developer generated by the rotation of the agitation member, at positions furthest from each other along a flow of the developer from the outlet of the developer return passage and the opening of the developer supply passage, a level sensor which measures an amount of the developer in the storage tank;

an agitation motor which rotates the agitation member; and a control unit which adjusts a rotation speed of the agitation motor to different levels of the rotation speed in accordance with the amount of the developer in the storage tank which is measured by the level sensor.

* * * * *